US005685578A

United States Patent [19]

Schneider

[11] Patent Number: 5,685,578

[45] Date of Patent: Nov. 11, 1997

[54] LOCKING MECHANISM FOR A TRAILER DOOR

[75] Inventor: Robert H. Schneider, Beaver Dam, Wis.

[73] Assignee: Versa Technologies, Inc., Racine, Wis.

[21] Appl. No.: 533,611

[22] Filed: Sep. 25, 1995

[51] Int. Cl.[6] ..... E05G 1/06

[52] U.S. Cl. ..... 292/144; 292/163; 292/DIG. 32; 70/DIG. 48

[58] Field of Search ..... 292/144, 163, 292/164, DIG. 32, 207, 218, 106; 70/275, DIG. 48

[56] References Cited

U.S. PATENT DOCUMENTS

| | | | |
|---|---|---|---|
| 401,574 | 4/1889 | Murphy | 292/207 |
| 425,323 | 4/1890 | Hornal | 292/207 |
| 982,086 | 1/1911 | O'Connor | 292/218 |
| 1,601,024 | 9/1926 | Jacobson | 292/207 |
| 1,764,443 | 6/1930 | Haseltine | 292/218 |
| 3,341,241 | 9/1967 | Carlson et al. | 292/207 |
| 3,601,453 | 8/1971 | Silverman | 303/89 |
| 3,614,147 | 10/1971 | Spector | 292/254 |
| 3,624,761 | 11/1971 | Kohn | 180/112 |
| 3,843,174 | 10/1974 | Bogunovich et al. | 292/166 |
| 3,950,018 | 4/1976 | Pickering | 292/144 |
| 3,978,618 | 9/1976 | Malo | 49/449 |
| 4,057,273 | 11/1977 | Carr | 292/218 |
| 4,090,731 | 5/1978 | Bopp et al. | 296/28 C |
| 4,196,602 | 4/1980 | Akselsen | 70/211 |
| 4,601,501 | 7/1986 | Pastva | 292/218 |
| 4,768,816 | 9/1988 | Bakula | 292/218 |
| 4,866,963 | 9/1989 | Leininger et al. | 70/278 |
| 5,050,916 | 9/1991 | Pastva | 292/217 |
| 5,062,669 | 11/1991 | McManigal et al. | 292/60 |

*Primary Examiner*—Steven N. Meyers
*Assistant Examiner*—Gary Estremsky
*Attorney, Agent, or Firm*—Andrus, Sceales, Starke & Sawall

[57] ABSTRACT

A door locking mechanism for use with a door having a door latch assembly and a stationary catch includes a locking rod movable between a locking position and a release position. In its locking position, the locking rod extends into aligned passages formed in a latch member and a stationary catch member of a door latch assembly, which are engaged with each other in a latched position to maintain the door in a closed position. This prevents disengagement of the latch member from the catch member, to prevent opening of the door. In its release position, the locking rod is withdrawn from at least the latch member passage, to enable the latch member to be disengaged from the catch member and to allow opening of the door. The locking rod is interconnected with a piston disposed within a cylinder. A spring urges the piston toward a position placing the locking rod in its locking position. Fluid pressure is selectively provided to the side of the piston opposite the spring, for selectively overcoming the biasing force of the spring and to move the piston to a position placing the locking rod in its release position. The locking mechanism can be advantageously used with a trailer having a pneumatic system, such that supply of pressurized air in the trailer's pneumatic system is communicated to the piston to place the locking rod in its release position whenever a source of air pressure exceeding a predetermined threshold is connected to the trailer's pneumatic system.

8 Claims, 3 Drawing Sheets

LOCKING MECHANISM FOR A TRAILER DOOR

BACKGROUND AND SUMMARY OF THE INVENTION

This invention relates to a locking mechanism for use with a door or other arrangement in which a latch member is selectively engageable with a catch member, for selectively preventing disengagement of the latch member from the catch member.

It is often desirable to maintain a door latch assembly in a latched condition for keeping a door closed. In many cases, this is done by means of a lock mechanism associated with the movable components of the door latch assembly, for preventing the door latch assembly from movement away from its latched position. In some door and latch assembly applications, however, this type of locking arrangement is not feasible or is impractical, due to the construction and operation of the latch components. One such environment is a semitrailer, which includes a pair of door panels and a bar-and-handle latch assembly including a pair of latches at spaced ends of a bar. The latches are engageable with stationary catches located above and below the door, which receive the latch members.

It is an object of the present invention to provide a door locking mechanism which is usable with a door having a latching assembly consisting of a latch member engageable with a catch member in a latched position, for maintaining the door in a closed position. It is a further object of the invention to provide such a locking mechanism which is relatively simple in its components, construction and operation, yet which provides extremely secure and positive retention of the latch member in its latched position. It is a further object of the invention to provide a door locking mechanism for a semitrailer having a pressurized fluid system, which enables the latch member to be disengaged from the catch member only when the trailer pressurized fluid system is pressurized above a predetermined threshold.

In accordance with the invention, a locking mechanism is provided for a door, such as that associated with a trailer, which is movable between an open position and a closed position. The door includes a latch assembly having a stationary catch member mounted adjacent the door, such as to the trailer, and a movable latch member movably mounted to the door and engageable with the catch member in a latched position for maintaining the door in its closed position. The locking mechanism of the invention contemplates a lock member movable between a locking position in which the lock member is engageable with a latch member when the latch member is in its latched position, and a release position in which the lock member is moved out of engagement with the latch member for enabling movement of the latch member away from its latched position. The lock member may be in the form of a rod, and the catch member and latch member are preferably provided with passages which are in alignment with each other when the latch member is in its latched position. When the rod is in its locking position, an end portion of the rod extends through the catch member passage and into the latch member passage for preventing movement of the latch member away from its latched position. In its release position, the end portion of the locking rod is withdrawn from the latch member passage so that the latch member can be disengaged from the catch member. The locking mechanism of the invention further includes a biasing member, such as a spring, which urges the rod toward its locking position. The rod is movable to its release position against the force of the spring by operation of a pressurized fluid system, such as a pneumatic system associated with a trailer. In a preferred form, the locking rod is mounted to a piston slidably received within a housing defining first and second ends. The spring bears between the piston and a first end of the housing to bias the piston toward the second end of the housing, which functions to bias the locking rod toward its locking position. The pressurized fluid system is selectively operable on the piston so as to selectively move the piston toward the first end of the housing against the biasing force of the spring, to move the locking rod to its release position. When the invention is used in combination with a trailer having a floor and support structure over which the floor is located adjacent the door, the locking rod is mounted to the trailer support structure below the floor. The locking rod extends from a housing secured to the trailer support structure, which encloses the piston and spring assembly. The locking rod extends in a direction toward the stationary catch member. The trailer support structure includes one or more support members between the housing and the stationary catch member, and the locking rod extends through openings formed in each of the support members which provides support to the locking rod between the housing and the catch member. A valve is disposed between the trailer pressurized fluid system and the housing, for supplying pressurized fluid to the housing only upon pressurization of the trailer pressurized fluid system. Typically, the trailer pressurized fluid system is only pressurized during operation of the tractor of a tractor/trailer combination into which the trailer is incorporated, thus ensuring that the trailer can only be opened while the tractor is being operated. Thus, when the trailer is being stored and is disconnected from a tractor, the locking rod is moved under the force of the spring to its locking position, to prevent the trailer door from being opened.

The invention further contemplates a method of locking a door in a closed position, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
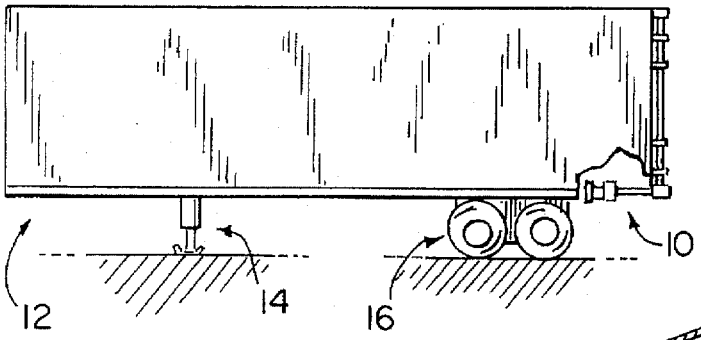
FIG. 1 is a side elevation view of a trailer in combination with which the door locking mechanism of the invention is utilized.
Figure 2:
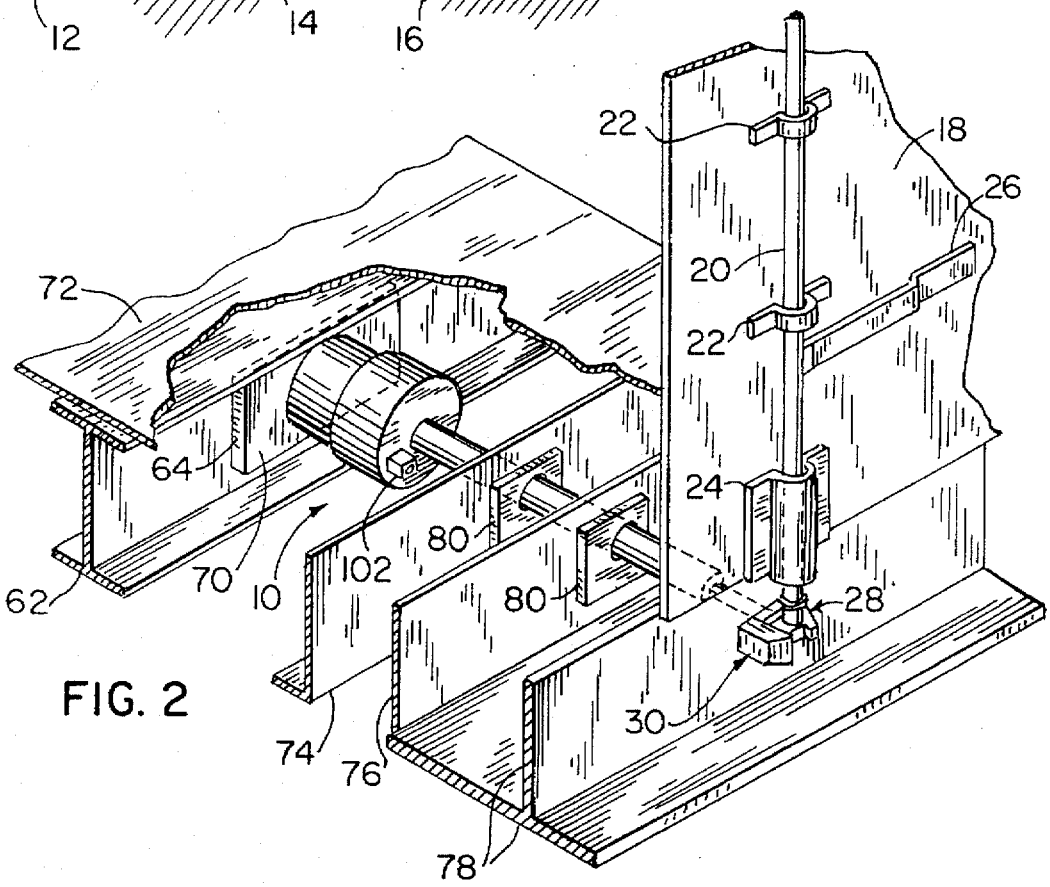
FIG. 2 is a partial isometric view showing a portion of the trailer of FIG. 1 and the door locking mechanism of the invention.

Referring to FIGS. 1 and 2, a door locking mechanism 10 is shown installed on a semitrailer 12. Trailer 12 is of conventional construction, and is normally adapted to be pulled behind a tractor or other towing vehicle. When trailer 12 is not being towed and is parked as shown, a jack 14 is engageable with the ground forwardly of the trailer's wheels 16 for maintaining trailer 12 level.

Trailer 12 includes a pair of rear door panels, one of which is shown in FIG. 2 at 18. When trailer 12 is parked, the door panels such as 18 are closed so as to prevent access to the interior of trailer 12. In a manner to be explained, door locking mechanism 10 functions to prevent the trailer door panels such as 18 from being opened while trailer 12 is parked and disconnected from its towing vehicle.

In accordance with conventional construction, trailer 12 includes a door latch assembly for selectively maintaining the trailer door panels, such as 18, in their closed position. Referring to FIG. 2, the door latch assembly includes a locking bar 20 pivotably mounted to door panel 18 via a series of brackets 22, 24. A handle 26 defines a pair of spaced ends, one of which is mounted to locking bar 20 for enabling an operator to pivot locking bar 20.

The upper and lower ends of locking bar 20 extend above and below the upper and lower edges, respectively, of door panel 18. A latch member, such as 28, is secured to locking bar 20 at each of its upper and lower ends. Catch members, such as 30, are stationarily secured to the rear framework of trailer 12 for receiving the latch members, such as 28, when the door panels 18 are closed. The latch members, such as 28, are engaged with the catch members, such as 30, by pivoting locking bar 20 via handle 26 to a latched position as shown in FIG. 2, in which the latch members 28 are received by and engaged with the catch members 30, to maintain door panel 18 in its closed position.

In accordance with the invention, door locking mechanism 10 is operable to selectively maintain the latch and catch members 28, 30, respectively, in their latched position as shown in FIG. 2.

Figure 3:
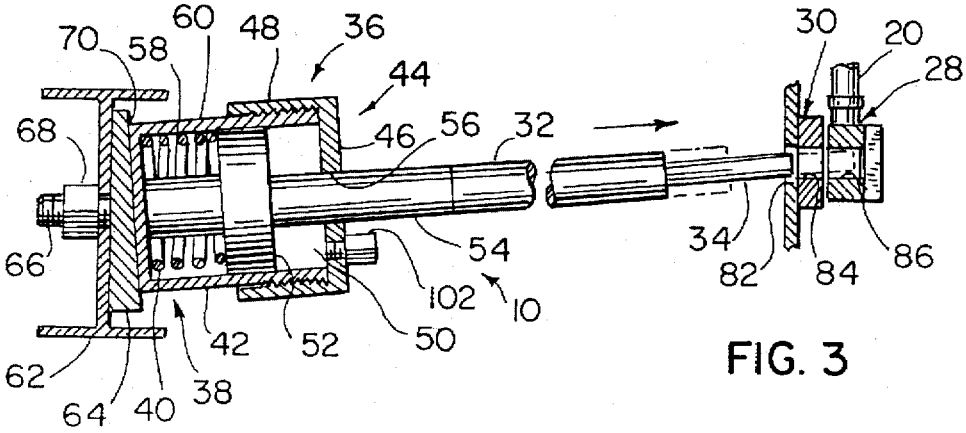
FIG. 3 is a partial side sectional view of the trailer and door locking components illustrated in FIG. 2.

Referring to FIG. 3, door locking mechanism 10 includes a locking rod 32 having a reduced-diameter end portion 34. Locking rod 32 extends from a housing 36, defined by a cylinder 38 having an end wall 40 and a side wall 42, in combination with an end cap 44 having an end wall 46 and a side wall 48. The end portion of cylinder side wall 42 is provided with external threads, and the inside of end cap side wall 48 is provided with mating internal threads such that end cap 44 is threadedly engageable with cylinder 38. With this construction, cylinder 38 and end cap 44 cooperate to enclose an internal passage 50 defined by cylinder 38.

A piston 52 is slidably received within passage 50, and has a cross section corresponding to that of the inside surface of cylinder side wall 42. Preferably, an O-ring or the like (not shown) is secured about the periphery of piston 52 for isolating the opposite sides of piston 52 from each other. A stub shaft 54 is mounted to piston 52, extending rearwardly therefrom through an opening 56 formed in end cap end wall 46. Locking rod 32 is secured to the end of stub shaft 54. A stop block 58 is mounted to the opposite side of piston 54, extending forwardly toward cylinder end wall 40. A spring 60 bears between the inside surface of cylinder end wall 40 and the forward surface of piston 52, for urging piston 52 rearwardly within passage 50.

Referring to FIGS. 2 and 3, cylinder 38 is mounted to the web of a structural cross-member of trailer 12, shown at 62, via a base plate 64. Base plate 64 includes threaded studs 66 which extend through openings formed in the web of cross-member 62, and nuts 68 engage threaded studs 66 for mounting base plate 64 to cross-member 62. Base plate 64 is shaped such that it has a greater thickness at its lower end than at its upper end. Cylinder 38 is mounted to the rear surface of base plate 64, shown at 70, in any satisfactory manner, such as by welding or the like. With this construction of base plate 70, the longitudinal axis of passage 50 defined by cylinder 38 is at an inclined angle relative to horizontal, resulting in a similar inclination of the longitudinal axis of locking rod 32, such that locking rod 32 extends upwardly in a rearward direction toward catch member 30. This provides sufficient clearance for cylinder 38 and end cap 44 below the inside floor of trailer 12, shown at 72 (FIG. 2). In accordance with conventional construction, floor 72 overlies and is supported by the trailer cross-members, such as 62, as well as additional trailer structural members 74, 76 and 78. Catch member 30 is mounted to the vertical component of rearwardmost trailer structural member 78.

As shown in FIGS. 2 and 3, locking rod 32 extends through aligned openings formed in the vertical components of trailer structural members 74, 76 and 78. Reinforcing blocks 80 are mounted to trailer structural members 74, 76 over the openings through which locking rod 32 extends, and themselves include openings accommodating passage of locking rod 32 therethrough.

As shown in FIG. 3, the opening formed in the vertical component of trailer structural member 78 is shown at 82, which accommodates passage of locking rod reduced end portion 34 therethrough. A bore 84 is formed in catch member 30 extending completely therethrough, and a bore 86 is formed in latch member 28 extending partially therethrough. Catch member bore 84 is in alignment with bore 82, and latch member bore 86 is in alignment with bores 82, 84 when latch member 28 is in its latched position as shown in FIGS. 2 and 3.

Figure 9:
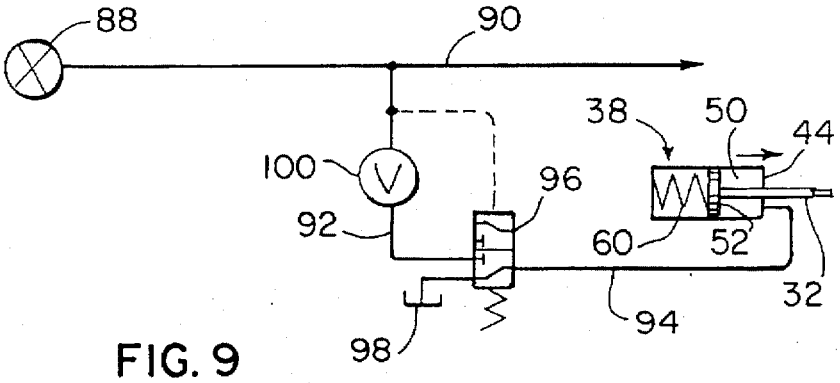
FIG. 9 is a partial schematic diagram of the pneumatic system for operating the door locking mechanism of FIGS. 2 and 3.

Referring to FIG. 9, trailer 12 includes a conventional pressurized air system. The trailer pressurized air system is connectable to the pressurized air system of the tractor via a gladhand 88. The trailer pressurized air system includes a line 90 extending from gladhand 88 to the trailer's parking brakes, so as to set the parking brakes when pressurized air in line 90 falls below a predetermined level.

Figure 4:
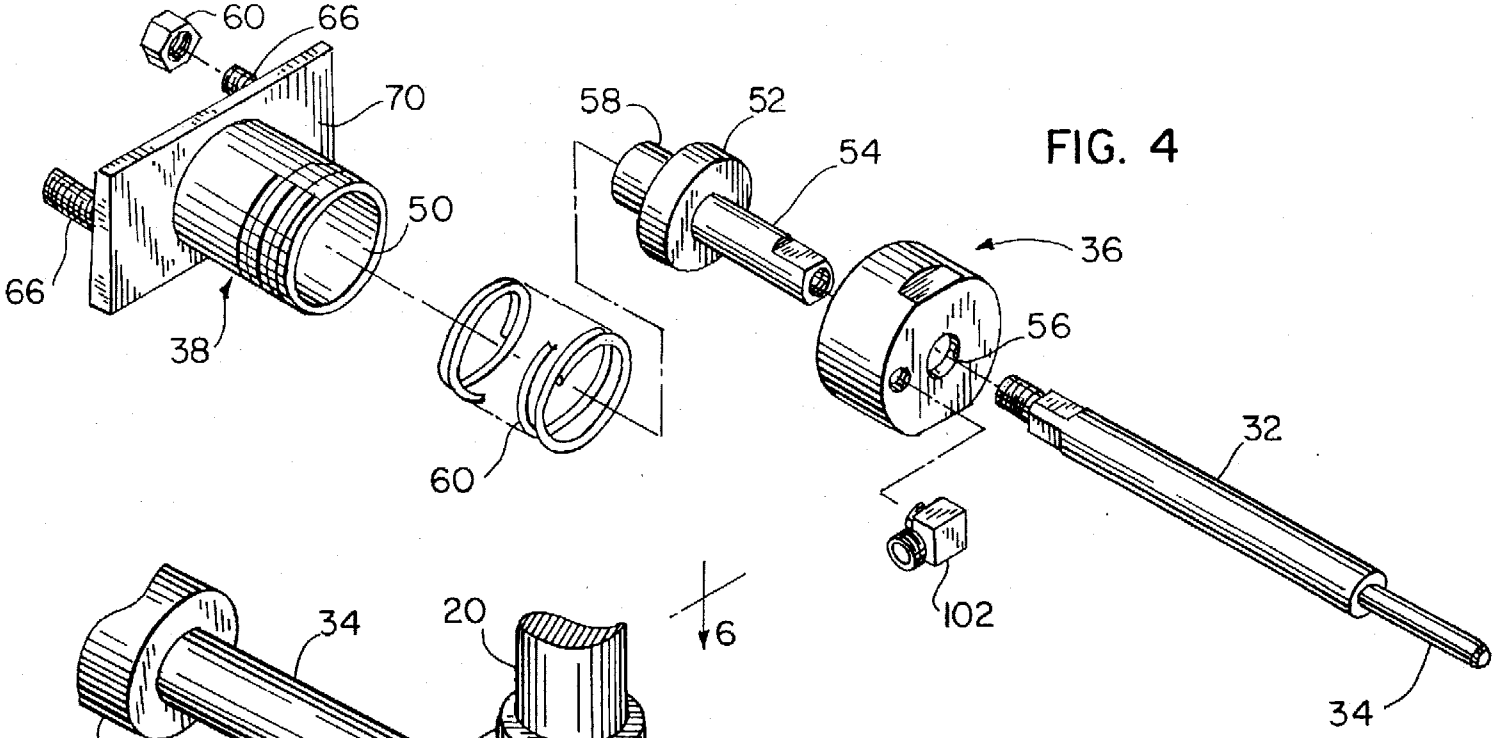
FIG. 4 is an exploded isometric view of the door locking mechanism shown in FIGS. 2 and 3.
Figure 5:
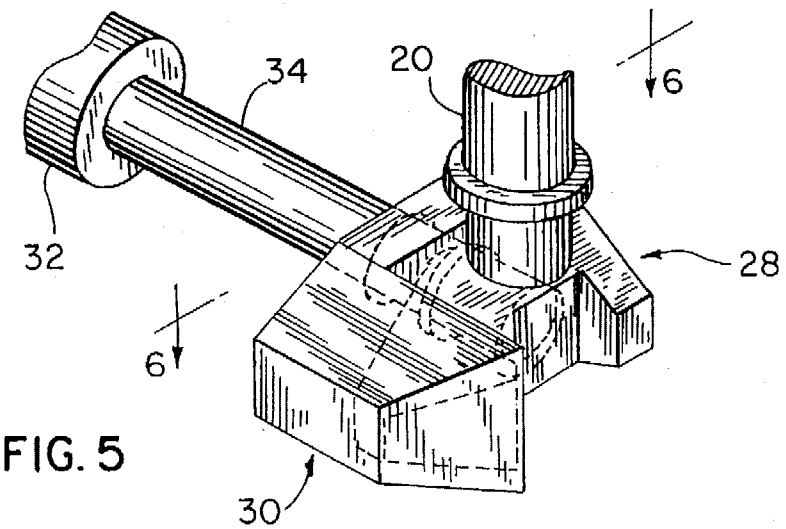
FIG. 5 is a partial isometric view showing the door latch assembly in a latched position and the locking mechanism in a locking position.

In accordance with the invention, a line 92 is connected to line 90, and is interconnected with a line 94 through a pilot-operated two-position three-way valve 96. In an operative position, valve 96 is positioned so as to establish communication between lines 92 and 94, and in an inoperative position as shown in FIG. 9 valve 94 provides communication between line 94 and an exhaust 98. Valve 96 is spring-biased toward its inoperative position as shown in FIG. 9. A pressure protection valve 100 is disposed within line 92. At its end opposite valve 96, line 94 is in communication with cylinder internal passage 50 via a nipple 102 (FIGS. 2–4).

Figure 6:
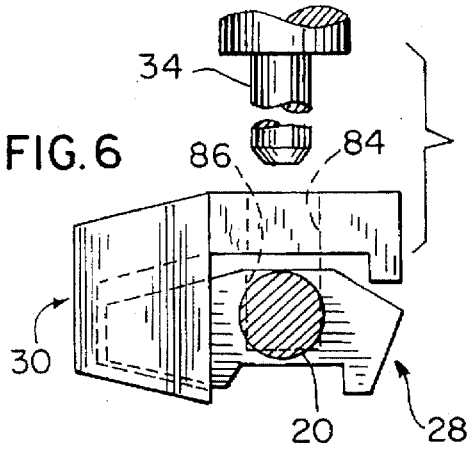
FIG. 6 is a top plan view showing a portion of the door locking mechanism of the invention and the door latch and catch members in a latched position.
Figure 7:
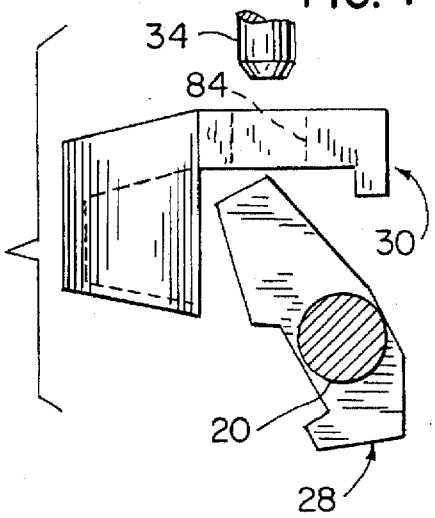
FIGS. 7 and 8 are views similar to FIG. 6, showing the door latch and catch members upon disengagement of the latch member from the catch member.
Figure 8:
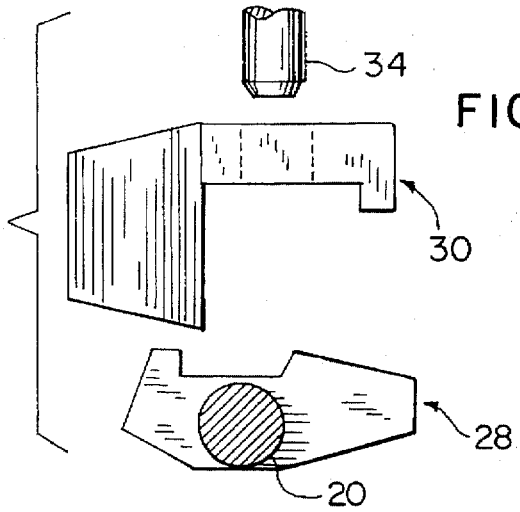

In operation, locking mechanism 10 functions as follows. When trailer 12 is parked and the tractor gladhand is disconnected from trailer gladhand 88 to relieve pressure in trailer pneumatic line 90 and to set the trailer parking brake, pressure is also relieved in lines 92 and 94, causing valve 96 to move to its exhaust position as shown in FIG. 9 under the force of its biasing spring. This opens passage 50 to exhaust 98, relieving pressure in cylinder internal passage 50. With the trailer door panels closed and latch member 28 in its latched position, as shown in FIG. 2, with respect to catch 30, spring 60 moves piston 52 rearwardly within passage 50 of cylinder 38 to move locking rod reduced end portion 34 into latch member bore 86, as shown in phantom in FIG. 3, through catch member bore 84. Rearward movement of piston 52 within passage 50 is limited by engagement of piston 52 with end cap end wall 46. When locking rod end portion 34 is in its locking position, latch member 28 cannot be disengaged from catch member 30 through the disengagement sequence which can normally be carried out as shown in FIGS. 6–8. This way, the door panels, such as 18, of trailer 12 cannot be opened when trailer 12 is parked, without supplying a source of pressurized air to trailer gladhand 88. Normally, it will only be desirable to open the trailer door panels, such as 18, when trailer 12 is connected to a tractor or other towing vehicle, such as when trailer 12 is moved by the towing vehicle to a loading dock or the like. When trailer 12 is connected to the towing vehicle and the vehicle's pressurized air system is connected to the trailer's pressurized air system via gladhand 88, the air pressure in line 90 is transferred to line 92, and pilot pressure in line 92 moves valve 96 to its operative position in which communication is established between lines 92 and 94. Pressurized air is thus supplied to cylinder internal passage 50, which acts against the rear side of piston 52 to move piston 52 forwardly against the force of spring 60. Forward movement of piston 52 within passage 50 is limited by engagement of stop block 58 with cylinder end wall 40. This movement of piston 52 causes forward movement of locking rod 32, resulting in its end portion 34 being withdrawn from latch member passage 86. This way, as long as air pressure is supplied to trailer 12, locking rod 32 is retracted to its solid-line release position of FIG. 3, enabling latch member 28 to be disengaged from catch member 30 in its usual sequence as shown in FIGS. 6–8 and allowing the door panels, such as 18, to be opened.

Pressure protection valve 100 ensures that, in the event of a failure of any of the components of locking mechanism 10 which result in a loss of air pressure, adequate air pressure is still supplied to trailer air line 90 to operate the brakes of trailer 12.

The door locking mechanism of the invention has been shown and described with reference to a trailer door. However, it is to be understood that the door locking mechanism of the invention could also be used in any other environment in which it is desired to prevent disengagement of a door latch member from a door catch member when the door is closed.

Various alternatives and embodiments are contemplated as being within the scope of the following claims particularly pointing out and distinctly claiming the subject matter regarded as the invention.

I claim:

1. A locking mechanism for attachment to a trailer having a trailer door movable between an open position and a closed position and including a pressurized fluid system, comprising:

a door latch assembly including a stationary catch member for mounting to the trailer and a latch member for mounting to the door, wherein the latch member is movable between a latched position in which the latch member is engaged with the catch member for maintaining the door in its closed position and a release position in which the latch member is disengaged from the catch member for enabling movement of the door to its open position;

a lock member adapted to be movably mounted to the trailer, wherein the lock member is movable between a locking position in which the lock member is engaged with the latch member when the latch member is in its latched position for preventing movement of the latch member away from its latched position, and a release position in which the lock member is moved out of engagement with the latch member for enabling movement of the latch member away from its latched position, wherein the lock member comprises a locking rod adapted to be movably mounted to the trailer and wherein the catch member and the latch member include passages in alignment with each other when the latch member is in its latched position, and wherein the locking rod in its locking position extends through the catch member passage and into the latch member passage, and in its release position is withdrawn from the latch member passage; and bias means for urging the locking rod toward its locking position, and wherein the locking rod is movable to its release position against the force of the bias means by operation of the trailer pressurized fluid system.

2. The locking mechanism of claim 1, wherein the locking rod is mounted to a piston slidably received within a housing defining first and second ends, wherein the bias means comprises a spring bearing between the piston and the first end of the housing to bias the piston toward the second end of the housing, and wherein the pressurized fluid system is selectively operable on the piston to move the piston toward the housing first end against the biasing force of the spring.

3. A trailer door locking mechanism, comprising:

a trailer including a door movable between an open position and a closed position; a floor adjacent the trailer door; and support structure for supporting the floor;

a door latch assembly including a stationary catch member mounted to the trailer and a latch member mounted to the door, wherein the latch member is movable between a latched position in which the latch member is engaged with the catch member for maintaining the door in its closed position and a release position in which the latch member is disengaged from the catch member for enabling movement of the door to its open position; and a lock member movably mounted to the trailer, wherein the lock member is movable between a locking position in which the lock member is engaged with the latch member when the latch member is in its latched position for preventing movement of the latch member away from its latched position, and a release position in which the lock member is moved out of engagement with the latch member for enabling movement of the latch member away from its latched position, wherein the lock member comprises a locking rod movably mounted to the trailer, wherein the locking rod is mounted to the trailer support structure below the floor, and wherein the catch and the latch member include passages in alignment with each other when the latch member is in its latched position, wherein the locking rod in its locking position extends through the catch member passage and into the latch member passage, and in its release position is withdrawn from the latch member passage.

4. The locking mechanism of claim 3, wherein the locking rod extends from a housing secured to the trailer support structure, wherein the housing encloses a mechanism for moving the locking rod between its locking and release positions, and wherein the locking rod extends in a direction toward the stationary catch member.

5. The locking mechanism of claim 4, wherein the housing is mounted to a base plate engageable with a surface of the support member lying in a plane substantially perpendicular to the floor, wherein the base plate is constructed so as to orient a longitudinal axis of the housing and of the locking rod in a direction toward the stationary catch member.

6. The locking mechanism of claim 3, wherein the locking rod extends from a housing secured to a support member forming a part of the trailer support structure, and wherein the trailer support structure further includes one or more additional support members located between the housing and the stationary catch member, wherein the locking rod extends through an opening formed in each of the one or more additional support members and is supported thereby between the housing and the stationary catch member.

7. A method of locking a door in a closed position, wherein the door includes a movable latch member engaged with a stationary catch member when the door is in its closed position, comprising the steps of:

mounting a movable locking rod adjacent the door for movement between a locking position in which the locking rod is engaged with the latch member and a release position in which the locking rod is disengaged from the latch member;

forming passages in the catch member and the latch member such that the passages are in alignment with each other when the latch member is engaged with the catch member so as to maintain the door in its closed position;

selectively engaging the locking rod with the latch member when the latch member is engaged with the stationary catch member to retain the latch member in engagement with the catch member; and selectively releasing engagement of the locking rod with the latch member to enable disengagement of the latch member from the catch member, wherein the steps of selectively engaging the locking rod with the latch member and selectively releasing engagement of the locking rod with the latch member are carried out by operating mechanism including a piston with which the locking rod is interconnected, a spring acting against the piston for urging the locking rod toward its locking position, and a pressurized fluid system in which pressurized fluid is selectively exposed to the piston to overcome the spring force and forcing the piston to move within the housing so as to place the locking rod in its release position.

8. The method of claim 7, wherein the door is mounted to a trailer having a pressurized fluid system, and wherein the pressurized fluid system carries out the steps of exposing the piston to pressurized fluid upon introduction of pressure to the trailer pressurized fluid system which exceeds a predetermined threshold to move the piston within the housing so as to place the locking rod in its release position against the force of the spring, and relieving pressure on the piston when pressure in the trailer pressurized fluid system is relieved so as to result in movement of the piston under the influence of the spring to move the locking rod to its locking position.

* * * * *